US011473341B2

(12) United States Patent
Chen et al.

(10) Patent No.: US 11,473,341 B2
(45) Date of Patent: Oct. 18, 2022

(54) SLIDING WINDOW EMERGENCY OPENING SYSTEM

(71) Applicant: Changchun Kuoer Technology Co., Ltd., Jilin (CN)

(72) Inventors: Dapeng Chen, Jilin (CN); Kuotian Liu, Jilin (CN)

(73) Assignee: Changchun Kuoer Technology Co., Ltd., Jilin (CN)

( * ) Notice: Subject to any disclaimer, the term of this patent is extended or adjusted under 35 U.S.C. 154(b) by 691 days.

(21) Appl. No.: 16/476,413

(22) PCT Filed: Jan. 8, 2018

(86) PCT No.: PCT/CN2018/071704
§ 371 (c)(1),
(2) Date: Jul. 8, 2019

(87) PCT Pub. No.: WO2018/133682
PCT Pub. Date: Jul. 26, 2018

(65) Prior Publication Data

US 2020/0018109 A1 Jan. 16, 2020

(30) Foreign Application Priority Data

Jan. 19, 2017 (CN) ..... 201710038360.4

(51) Int. Cl.
*E05B 65/10* (2006.01)
*E05F 11/48* (2006.01)
(Continued)

(52) U.S. Cl.
CPC ..... *E05B 65/1033* (2013.01); *E05B 15/0046* (2013.01); *E05B 53/003* (2013.01); *E05F 11/48* (2013.01); *E05Y 2900/148* (2013.01)

(58) Field of Classification Search
CPC .... E05F 11/48; E05B 65/1033; E05B 65/104; E05B 15/0046; E05B 53/003; E05Y 2800/25; E05Y 2900/148
See application file for complete search history.

(56) References Cited

U.S. PATENT DOCUMENTS 4,019,281 A * 4/1977 Weiler ..... E06B 9/02 49/141
4,127,966 A * 12/1978 Schmidt ..... E05B 47/0603 49/141
(Continued)

FOREIGN PATENT DOCUMENTS

CN 201786153 U 4/2011
CN 204024296 U 12/2014
(Continued)

*Primary Examiner* — Justin B Rephann
(74) *Attorney, Agent, or Firm* — Bret E. Field; Bozicevic, Field & Francis LLP

(57) ABSTRACT

Disclosed is a sliding window emergency opening system, comprising: an emergency opening device (2) and a general opening control device (3); wherein a first rotary shaft (202) in the emergency opening device is rotatably mounted on a first base (201); a first pulling cable (206) is wound around the first rotary shaft (202), and one end thereof is connected with a movable sash of the sliding window (1); a first ratchet (203) is fixedly connected with the first rotary shaft (202); a first elastic component is compressed to make a first pawl (204) abut against the first ratchet (203); a second rotary shaft (302) in the general opening control device (3) is rotatably mounted on a second base (301); one end of a general control pulling cable (303) is connected with the second rotary shaft (302), and the other end is connected with the first pawl (204); when the second rotary shaft (302) rotates, the general control pulling cable (303) is wound up to make the first pawl (204) detached from the first ratchet (203); under the action of the gravity of the movable sash in
(Continued)

the sliding window, the first pulling cable (206) drives the first rotary shaft (202) to rotate so as to open the movable sash. In practical application, the general opening control device (3) may be provided at a location far from the emergency opening device (2), and the emergency opening device may be remotely controlled to open the movable sash.

10 Claims, 6 Drawing Sheets

(51) Int. Cl.
*E05B 15/00* (2006.01)
*E05B 53/00* (2006.01)

(56) References Cited

U.S. PATENT DOCUMENTS 4,578,900 A 4/1986 Hannay
4,631,862 A * 12/1986 Gallardo ..... E06B 9/04 49/56
4,638,596 A * 1/1987 Gallardo ..... E06B 9/04 49/141
4,841,673 A * 6/1989 Tjomsland ..... E05B 65/1033 49/141
5,144,770 A * 9/1992 Kraus ..... E05F 11/40 49/362
5,572,830 A * 11/1996 Freeman ..... E05F 13/04 49/273
5,839,230 A * 11/1998 Licking ..... E05F 15/57 49/141
2006/0101718 A1* 5/2006 Fronz ..... B61D 19/008 49/141
2013/0318875 A1* 12/2013 Hansen ..... E05F 15/665 49/352
2020/0109597 A1* 4/2020 Tu ..... E05C 3/124

FOREIGN PATENT DOCUMENTS

CN 204024307 U 12/2014
CN 204677041 U 9/2015
CN 204827000 U 12/2015
CN 205172264 U 4/2016
CN 205422431 U 8/2016
JP S61-155583 A 7/1986
JP S6312030 A 1/1988
JP 4012089 B2 11/2007
JP 2010133221 A 6/2010
JP 2011047198 A 3/2011

* cited by examiner

SLIDING WINDOW EMERGENCY OPENING SYSTEM

CROSS-REFERENCE TO RELATED APPLICATION

This application claims the benefit of CN Application No. 201710038360.4 filed on Jan. 19, 2017, titled "SLIDING WINDOW EMERGENCY OPENING SYSTEM," which is incorporated herein by reference in its entirety.

FIELD OF THE INVENTION

The present invention relates to the technical field of sliding window, and in particular, to a sliding window emergency opening system.

BACKGROUND

Sliding window is a novel window that can realize opening of a window sash in the vertical direction, and it has been gradually applied to the engineering construction field. A sliding window mainly includes a movable sash, a window frame and an opening device. A pulling cable in the opening device is connected with the movable sash, the pulling cable drives the movable sash to move up and down along a reversible guide of the window frame. The power component in the opening device is a driving motor. The driving motor rotates and drives the pulling cable to move, thereby realizing the opening and closing of the movable window.

When emergency such as fire occurs in a building, it requires to open the vertical sliding window and exhaust the fume. On the other hand, when emergency such as fire occurs, it often encounters power failure, which makes the driving motor in the vertical sliding window unable to work normally. Although a mechanical emergency opening device has been provided in a prior art sliding window, due to hazards such as fire and high-temperature fume, it is very dangerous for an operating personnel to access the fire scene and initiate the emergency opening device. Therefore, it is necessary to provide a sliding window emergency opening system that can be applied to dangerous situations such as fire and the like.

SUMMARY OF THE INVENTION

Therefore, it is an object of the present invention to provide a sliding window emergency opening system, which may be applied to dangerous situations such as fire and the like to realize an emergency opening of a sliding window.

A sliding window emergency opening system according to the invention includes at least one emergency opening device and a general opening control device;

herein the emergency opening device includes a first base, a first rotary shaft, a first pulling cable, a first ratchet, a first pawl and a first elastic component; the first rotary shaft is mounted on the first base and may rotates with respect to the first base; the first pulling cable is wrapped on the first rotary shaft, and one end thereof is connected with a movable sash of the sliding window; the first ratchet is fixedly connected with the first rotary shaft; the first elastic component is compressively provided between the first base and the first pawl to make the first pawl clamp the first ratchet;

the general opening control device includes a second base, a second rotary shaft and a general control pulling cable; the second rotary shaft is mounted on the second base and may rotate with respect to the second base; one end of the general control pulling cable is connected with the second rotary shaft, and the other end is connected with the first pawl; when the second rotary shaft rotates, the general control pulling cable is wound to make the first pawl overcome the action of the first elastic component and detached from the first ratchet.

Optionally, each of the emergency opening devices includes a branch pulling cable, one end of which is connected with the first pawl;

Each of the branch pulling cables is connected with the general control pulling cable.

Optionally, each of the branch pulling cables includes a branch pulling cable body and a traction safety device;

the branch pulling cable body is connected with the general control pulling cable.

The traction safety device includes a second elastic component and a safety pulling cable.

The first end of the second elastic component and the first end of the safety pulling cable are both connected with the first pawl.

The second end of the second elastic component and the second end of the safety pulling cable are both connected with the branch pulling cable body.

The length of the safety pulling cable is equal to the maximum stretched length of the second elastic component, and the maximum deformation length of the second elastic component is larger than or equal to the maximum movement distance of the general control pulling cable.

Optionally, each of the emergency opening devices includes a linkage lever.

The linkage lever is hingedly mounted on the first base.

The first end of the linkage lever is connected with the first pawl; the second end of the linkage lever is connected with both the first end of the second elastic component and the first end of the safety pulling cable.

Optionally, the sliding window emergency opening system according to the invention includes a linkage guide seat.

The linkage guide seat includes a guide seat body and a guide bar, and the guide bar may slide with respect to the guide seat body.

The general control pulling cable is connected with the branch pulling cable in each of the emergency opening devices via the guide bar.

Optionally, the linkage guide seat further includes a guide wheel.

The guide wheel is mounted on the guide seat body.

The branch pulling cable is connected to the guide bar after bridging over the guide wheel.

Optionally, the general opening control device further includes a second ratchet, a second pawl and a third elastic component.

The second ratchet is fixedly connected with the second rotary shaft.

A third elastic component is compressively provided between the second base and the second pawl to make the second pawl abut against the second ratchet.

After the second pawl is operated to overcome the compression elastic force of the third elastic component and make the second pawl detach from the second ratchet, the second rotary shaft may rotate with respect to the second rotary shaft so as to wind up the general control pulling cable.

Optionally, the general opening control device further includes a handle and a stop pin.

The handle is fixedly connected with the second rotary shaft, and the handle is provided with a first pin hole.

The second base is provided with a second pin hole corresponding to the first pin hole.

The stop pin may be inserted into both the first pin hole and the second pin hole.

Optionally, the sliding window emergency opening system according to the invention further includes a pulling cable sleeve sheathing the general control pulling cable.

Optionally, the sliding window emergency opening system according to the invention further includes: a screw that is connected with the first rotary shaft and rotates with the first rotary shaft;

a screw nut threaded with the screw;

a guide guiding the screw nut to move along the axial direction of the screw while restricting the rotation of the screw nut, wherein the guide is fixedly provided on the base;

a first friction component that is sleeved on the screw, rotates together with the screw and moves along the axial direction of the screw;

a second friction component that is fixedly mounted on the first base and frictionally cooperates with the first friction component, wherein the second friction component and the screw nut are located on the two opposite sides of the first friction component;

a fourth elastic component that is mounted between the first friction component and the screw nut;

when the rotary shaft rotates along a first direction, the pulling cable is unwound from the rotary shaft, and the screw nut moves toward the second friction component and presses against the fourth elastic component.

The sliding window emergency opening system according to the invention includes an emergency opening device and a general opening control device. The first pulling cable in the emergency opening device is wound around the first rotary shaft, and one end thereof is connected with a movable sash of the sliding window; a first ratchet is fixedly connected with the first rotary shaft, while a first elastic component is compressively provided between a first base and a first pawl to make the first pawl abut against the first ratchet. The general opening control device includes a second base, a second rotary shaft and a general control pulling cable. One end of the general control pulling cable is connected with the second rotary shaft, and the other end is connected with the first pawl of the emergency opening device. When the second rotary shaft rotates with respect to second base, the second rotary shaft winds up the general control pulling cable to make the first pawl overcome the action of the first elastic component and get detached from the first ratchet. At this point, under the action of the gravity of the movable sash in the sliding window, the first pulling cable drives the first rotary shaft to rotate so as to open the movable sash. In practical application, the general opening control device may be provided at a location far from the emergency opening device, and the movable sash may be remotely controlled to get opened by remotely initiating the emergency opening device.

BRIEF DESCRIPTION OF THE DRAWINGS

In order to more clearly illustrate the technical solutions of the embodiments of the invention or of the prior art, the drawings in conjunction with the description of the embodiments or the prior art will be briefly introduced below. Apparently, the drawings in conjunction with the description below are merely used for an easy understanding of some embodiments of the invention, and other drawings may also be obtained by one of ordinary skills in the art according to these drawings without creative work.

Wherein: 1—Sliding Window, 2—Emergency Opening Device, 201—First Base, 202—First Rotary Shaft, 203—First Ratchet, 204—First Pawl, 205—First Spring, 206—First Pulling Cable, 207—Branch Pulling Cable, 208—Branch Pulling Cable Body, 209—Pulling Cable Safety Device, 210—Second Spring, 211—Safety Pulling Cable, 212—Linkage Lever, 213—Screw, 214—Screw Nut, 215—Disc Spring, 216—First Friction Component, 217—Second Friction Component, 218—Sleeve, 219—Spring Positioning Nut, 3—General Opening Control Device, 301—Second Base, 302—Second Rotary Shaft, 303—General Control Pulling Cable, 304—Second Ratchet, 305—Second Pawl, 306—Third Spring, 307—Handle, 308—Stop Pin, 4—Linkage Guide Seat, 401—Guide Seat Body, 402—Guide Bar, 403—Guide Wheel, 5—Pulling Cable Sleeve

DETAILED DESCRIPTION OF THE EMBODIMENTS

The present invention provides a sliding window emergency opening system, wherein a general opening control device may be operated to control an emergency opening device mounted beside each movable window so as to release the first pulling cable, such that a movable sash of the sliding window may be dropped to open and a remote control of the sliding window may be achieved.

In order for one skilled in the art to better understand the technical solutions of the invention, the technical solutions in the embodiments of the invention will be described clearly and fully below in conjunction with the drawings of the invention. Apparently, the embodiments described only show some embodiments of the invention, rather than all of the possible embodiments. All other embodiments obtained by one of ordinary skills in the art based on the embodiments of the invention without creative efforts should be construed as falling in the protection scope of the invention.

Figure 1:
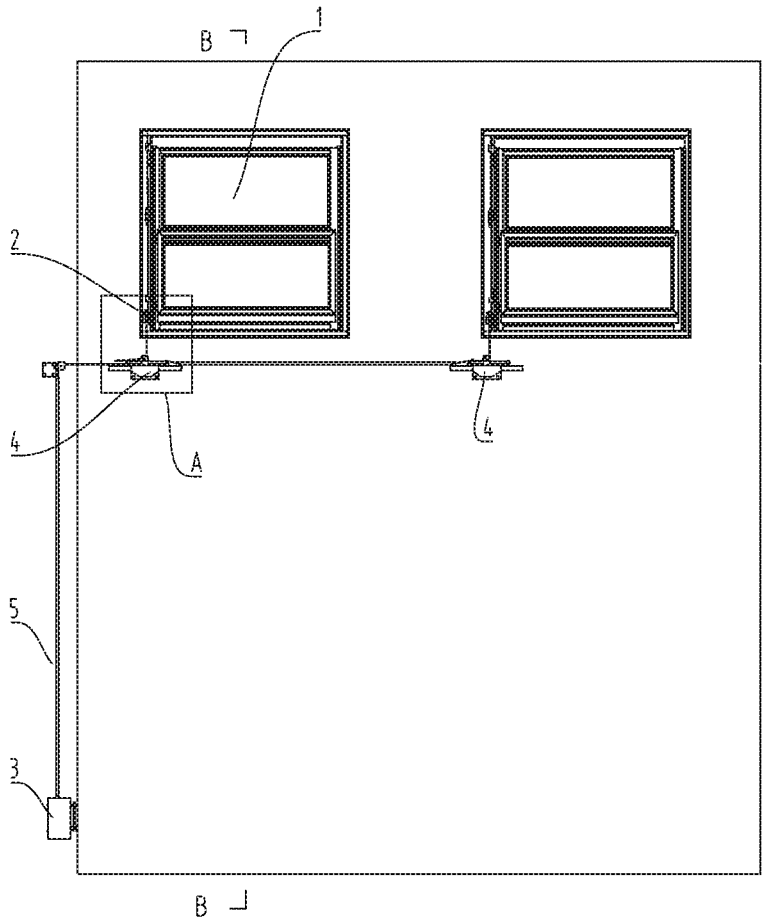
FIG. 1 is an overall schematic diagram of a sliding window and an emergency opening system according to an embodiment of the invention.

FIG. 1 is an overall schematic diagram of a sliding window 1 and an emergency opening system according to an embodiment of the invention. Referring to FIG. 1, two sliding windows 1 are provided in the application scenario of the embodiment of the invention, and each sliding window 1 is provided with one emergency opening device 2 beside; additionally, a general opening control device 3 connected with both of the two emergency opening devices 2 is further included. It is conceivable that, in other embodiments, the number of sliding windows 1 and emergency opening devices 2 is not limited to two; on the other hand, because the working principles and working processes by which the general opening control device 3 controls the emergency opening device 2 are the same, the embodiment will be introduced only by an example in which two emergency opening devices 2 are mounted.

Figure 2:
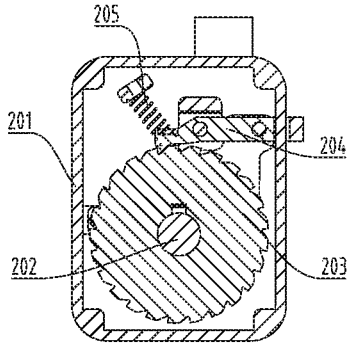
FIG. 2 is a schematic sectional view of an emergency opening device employed in an embodiment of the invention.

FIG. 2 is a schematic sectional view of an emergency opening device 2 employed in an embodiment of the invention. Referring to FIG. 2, the emergency opening device 2 in this embodiment includes a first base 201, a first rotary shaft 202, a first ratchet 203, a first pawl 204, a first spring 205 and a first pulling cable 206, wherein the first pulling cable 206 is not shown in this figure. Among which, the first rotary shaft 202 is mounted on the first base 201 and may rotate with respect to the first base 201; the first ratchet 203 is fixedly connected with the first rotary shaft 202 and may rotate with the first rotary shaft 202; one end of the first spring 205 is connected with the first base 201, and the other end thereof is connected with the first pawl 204; an elastic force generated by the compression of the first spring 205 makes the first pawl 204 clamp the first ratchet 203; the first pulling cable 206 is wrapped on the first rotary shaft 202, and one end thereof is connected with a movable sash in the sliding window 1.

Under the action of the elastic resilience of the first spring 205, the first pawl 204 clamps the ratchet teeth on the first ratchet 203, thus the first rotary shaft 202 is prevented from rotating, and the first pulling cable 206 is prevented from driving the first rotary shaft 202 to rotate under the action of the movable sash, thereby a locking action is realized, and the emergency opening of the movable sash is prevented.

Figure 3:
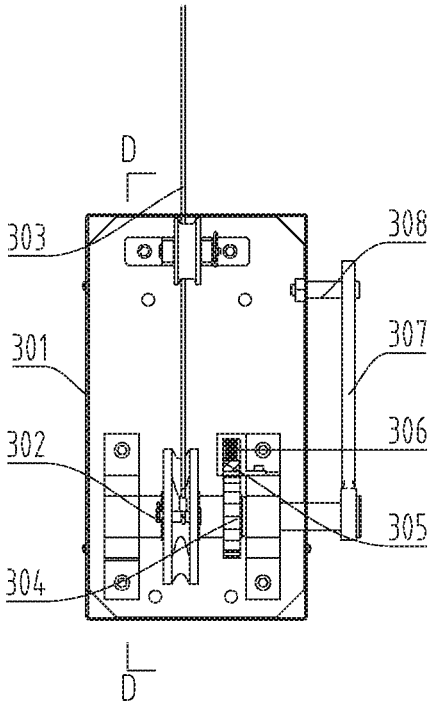
FIG. 3 is a schematic diagram of a general opening control device according to an embodiment of the invention.
Figure 4:
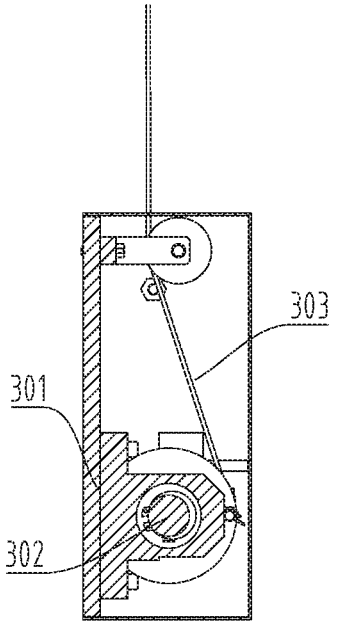
FIG. 4 is a schematic sectional view along D-D in FIG. 3.

FIG. 3 is a schematic diagram of a general opening control device 3 according to an embodiment of the invention, and FIG. 4 is a schematic sectional view along D-D in FIG. 3. Referring to FIG. 3 and FIG. 4, the general opening control device according to the embodiment of the invention includes a second base 301, a second rotary shaft 302 and a general control pulling cable 303; among which, the second rotary shaft 302 is mounted on the second base 301 and may rotate with respect to the second base 301; one end of the general control pulling cable 303 is connected with the second rotary shaft 302; when the second rotary shaft 302 rotates, the general control pulling cable 303 is wound on the second rotary shaft 302.

Additionally, the other end of the general control pulling cable 303 is further connected with the first pawl 204, and it may drive the first pawl 204 to overcome the elastic pressing force of the first spring 205 and get detached from the first ratchet 203. When an emergency such as fire occurs, by controlling the second rotary shaft 302 engaged on the general control pulling cable 303 to rotate, the first ratchet 203 in the emergency opening device 2 may be controlled to be detached from the first pawl 204. After the first ratchet 203 is detached from the first pawl 204, under the gravity of the movable sash, the first pulling cable 206 drives the first rotary shaft 202 to rotate so as to get unwrapped from the first rotary shaft 202, and the movable sash drops to open. Referring to FIG. 3, in this embodiment, a winding guide wheel is provided on the second rotary shaft 302, a general control pulling cable guide wheel is provided on the second base 301, and the general control pulling cable is wrapped on the winding guide wheel via a guide of the general control pulling cable guide wheel.

Referring to FIG. 3, in this embodiment, in order to facilitate a control of the rotation of the second rotary shaft 302 of the general control opening device, the emergency opening device 2 is further provided with a handle 307 that is fixedly connected with the second rotary shaft 302. In use, the second rotary shaft 302 may be driven to rotate by moving the handle 307.

Additionally, in order to prevent the second rotary shaft 302 of the general opening control device 3 from being triggered to rotate due to unexpected touch, in this embodiment, the general opening control device 3 is further provided with a component that locks and restricts the rotation of the second rotary shaft 302. Referring to FIG. 3, in this embodiment, the rotation of the second rotary shaft 302 is restricted in two modes:

1) The general opening control device 3 is provided with a second ratchet 304, a second pawl 305 and a third spring 306; the second ratchet 304 is fixedly connected with the second rotary shaft 302; the third spring 306 is compressively provided between the second base 301 and the second pawl 305, one end thereof being fixedly connected with the second base 301, and the other end being fixedly connected with the second pawl 305; an elastic resilience generated by the compression of the third spring 306 acts on the second pawl 305 to make the second pawl 305 clamp the ratchet tooth of the second ratchet 304; additionally, the end of the second pawl 305 protrudes to the outside of the second base 301. After the second pawl 305 is detached from the second ratchet 304 by operating the second pawl 305 to overcome the compression elastic force of the third spring 306, the clamping action between the second pawl 305 and the second ratchet 304 is released, that is, the restriction on the rotation of the second rotary shaft 302 by the second pawl 305 is released.

2) A first pin hole is provided on the handle 307, and a second pin hole is provided at a location on the second base 301 that is corresponded to the first pin hole; the first pin hole and the second pin hole are provided along the axis of the second rotary shaft 302; additionally, a stop pin 308 is further provided; the stop pin 308 may be inserted into both the first pin hole and the second pin hole; when the stop pin 308 is inserted into both the first pin hole and the second pin hole, the stop pin 308 restricts the rotation of the handle 307, thereby restricting the rotation of the second rotary shaft 302; on the other hand, when the stop pin 308 is detached from one of the first pin hole and the second pin hole, the locking between the handle 307 and the first base 201 is released, that is, the restriction on the rotation of the second rotary shaft 302 by the stop pin 308 is released.

Of course, in other embodiments, one locking mechanism of the above locking modes may be employed to lock the second rotary shaft 302.

In practical application, the general opening control device 3 may be mounted in a safety zone, for example, outdoors; while the emergency opening device 2 cooperating with each sliding window 1 is mounted and fixed on the frame of the sliding window 1 or on a wall, that is, the general opening control device 3 may control the initiation of each emergency opening device 2 via remote control. For example, for the application scenario shown in FIG. 1, the general opening control device 3 is provided outdoor, while the sliding window 1 and the corresponding emergency opening device 2 are provided at a high location indoor.

Figure 5:
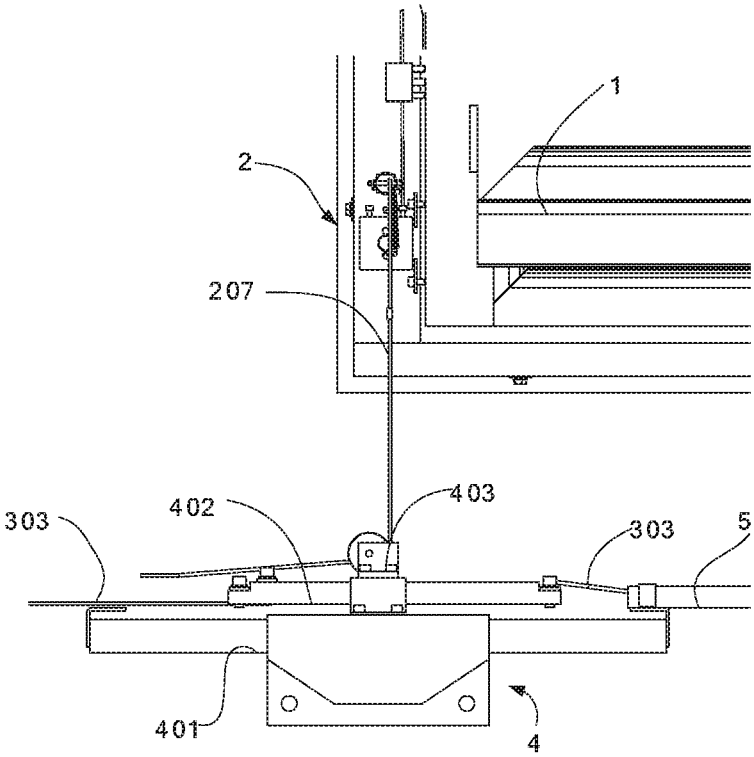
FIG. 5 is an enlarged view of a region A in FIG. 1.

FIG. 5 is an enlarged view of region A in FIG. 1. Referring to FIG. 5, in this embodiment, in order to control a plurality of emergency opening devices 2 overall via one general control pulling cable 303, each emergency opening device 2 is provided with a branch pulling cable 207; one end of each branch pulling cable 207 is connected with a corresponding first pawl 204, and the other end is connected with the general control pulling cable 303; the general control pulling cable 303 moves each branch pulling cable 207 by a pulling action, so that the corresponding first pawl 204 is detached from the respective first ratchet 203, and each corresponding emergency opening device 2 may be initiated.

In practical application, due to problems such as component damage, each emergency opening device 2 may have a possibility to fail. Specifically, the first pawl 204 in each emergency opening device 2 may not be detached from the first ratchet 203. Therefore, when the above general opening control device 3 is employed, there may be a problem that in case one emergency opening device 2 fails, the general opening control device 3 may not pull the general control pulling cable 303 to control other emergency opening devices to open.

In order to avoid the above problem, each branch pulling cable according to the embodiment of the invention is provided with a branch pulling cable body 208 and a pulling cable safety device 209, wherein the pulling cable safety device 209 may avoid the problem that other normal emergency opening devices 2 cannot be pulled by the general control pulling cable 303 in case one emergency opening device 2 fails.

Figure 6:
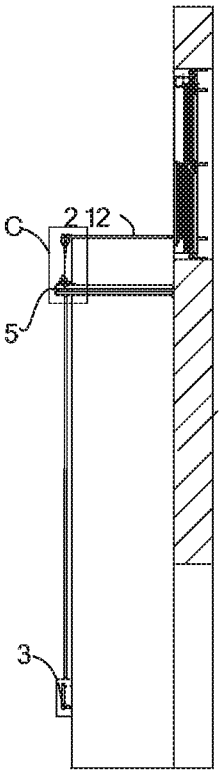
FIG. 6 is a schematic sectional view along B-B in FIG. 1.
Figure 7:
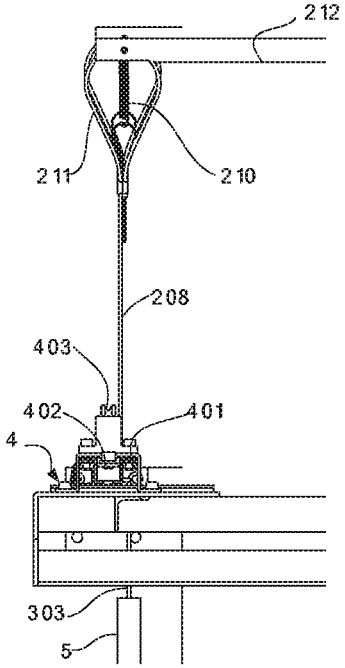
FIG. 7 is an enlarged view of a region C in FIG. 6.

FIG. 6 is a schematic sectional view along B-B in FIG. 1, and FIG. 7 is an enlarged view of region C in FIG. 6. Referring to FIG. 6 and FIG. 7, in this embodiment, the pulling cable safety device 209 includes a second spring 210 and a safety pulling cable 211. The upper end of the second spring 210 and the upper end of the safety pulling cable 211 are both connected with the first pawl 204, and the lower end of the second spring 210 and the lower end of the safety pulling cable 211 are both connected with the branch pulling cable body 208; the second spring 210 and the safety pulling cable 211 are provided in parallel; the other end of the branch pulling cable body is connected with the general control pulling cable 303.

In normal use, the safety pulling cable 211 is in a relaxed state. When the general control pulling cable 303 drags the branch pulling cable 207 to move, elastic deformation occurs to the second spring 210 in the pulling cable safety device, and the traction force of the general control pulling cable 303 is transmitted to the first pawl 204. At this point, the safety pulling cable 211 is still in relaxed state. If a component in the emergency opening device 2 is damaged, the second spring 210 will be further stretched and will be probably stretched to the maximum stretched length, which means the maximum stretched state that can still elastically spring back. The length of the safety pulling cable 211 is equal to the maximum stretched length of the second spring 210, thus when the second spring 210 is stretched to the maximum stretched state, the safety pulling cable 211 will be straightened to bear the elastic traction force of the general control pulling cable 303.

Additionally, in this embodiment, the maximum deformation/stretching length of the second spring 210 is larger than or equal to the maximum movement distance of the general control pulling cable 303 to pull each emergency opening device 2 to work, so as to guarantee that the normal emergency opening devices 2 are initiated before the second spring 210 in the failed emergency opening device 2 are stretched to the maximum length.

Still referring to FIG. 5 and FIG. 7, in the embodiment of the invention, the emergency opening device 2 further includes a linkage lever 212, and the pulling cable safety device is not directly connected to the first pawl 204, instead, it is connected to the first pawl 204 via the linkage lever 212, and the first pawl 204 is driven to move via a lever. Specifically, the linkage lever is hinged onto the first base 201, the first end of the linkage lever 212 is connected with the first pawl 204, the second end thereof is connected with both the first end of the second spring 210 and the first end of the safety pulling cable 211, and the first pawl 204 and the pulling cable safety device are both on the same side of the linkage lever 212.

In specific applications, if a plurality of emergency opening devices 2 are connected with one general opening control device 3, an operating personnel needs to apply a large acting force for using the general opening control device 3 to control all emergency opening device 2 to work; on the other hand, when the above linkage lever 212 is employed, the acting force required may be lowered by increasing the ratio of the moment arm of the pulling cable safety device to the moment arm of the first pawl 204; at the same time, because the stroke of the first pawl 204 is small, when the linkage lever 212 is employed, the general control pulling cable 303 needs to move a large stroke to make each emergency opening device 2 open, thus it may also prevent the following problem from happening: the emergency opening device 2 is accidentally triggered to work in normal conditions Referring to FIG. 5 and FIG. 7, the sliding window emergency opening system according to an embodiment of the invention further includes a linkage guide seat 4. The linkage guide seat 4 includes a guide seat body 401 and a guide bar 402, wherein the guide bar 402 may slide with respect to the guide seat body 401. One end of the branch pulling cable 207 in each emergency opening device 2 is fixedly connected with the guide bar 402, the general control pulling cable 303 is connected with the guide bar 402 too, and the general control pulling cable 303 drives each branch pulling cable 207 to move by dragging the guide bar 402 to move.

Referring to FIG. 1, in this embodiment, each sliding window 1 has a corresponding linkage guide seat 4, and each linkage guide seat 4 is located in the same horizontal direction. The general control pulling cable 303 directly connected with the general opening control device 3 is connected with the guide bar 402 on the linkage guide seat 4 that is closest to the general opening control device 3, and the guide bars 402 of the subsequent each linkage guide seat 4 are respectively connected via the corresponding general control pulling cable 303.

Moreover, each linkage guide seat 4 in the embodiment of the invention includes a guide wheel 403. The guide wheel 403 is mounted on the guide seat body 401, and the branch pulling cable 207 of each emergency opening device 2 is connected to the guide bar 402 after bridging over the guide wheel. Additionally, in order to avoid triggering the emergency opening device 2 by accidentally touching the general control pulling cable 303, in this embodiment, there further provides a pulling cable sleeve 5 covering/sheathing the general control pulling cable 303.

Figure 8:
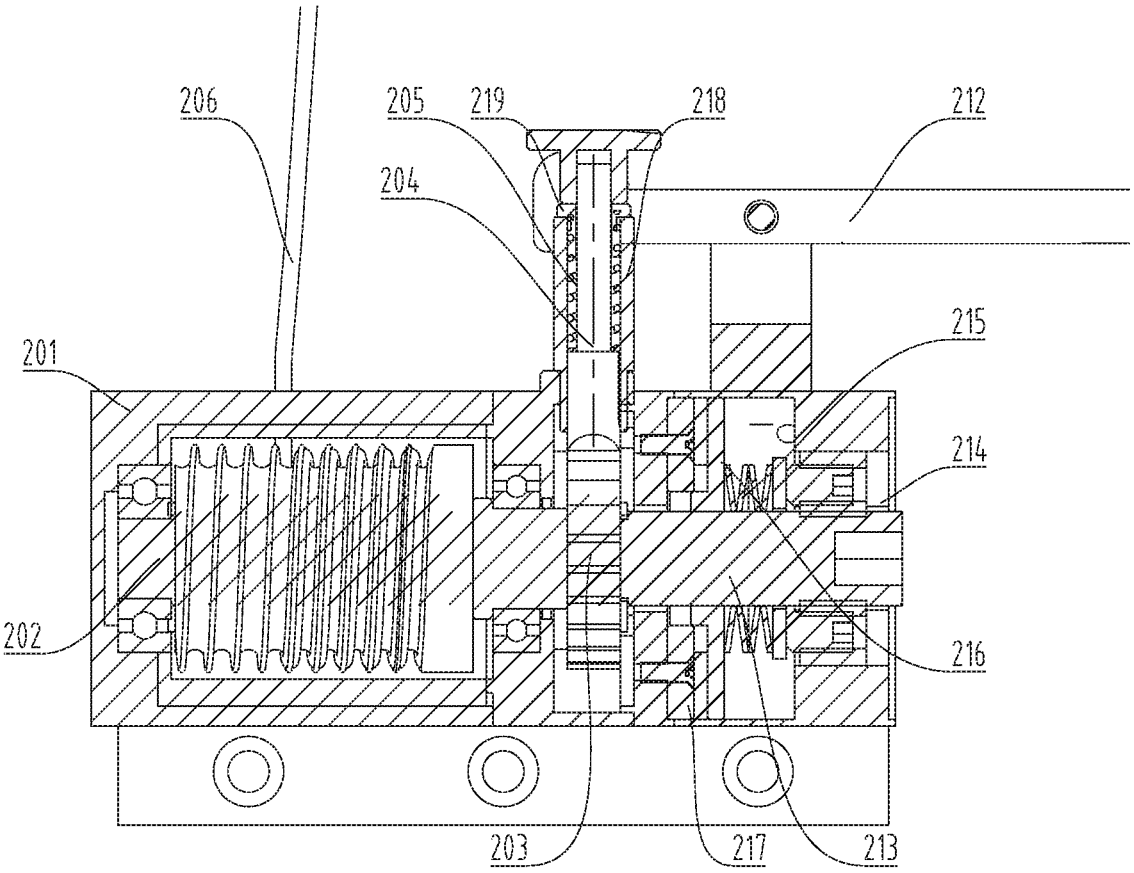
FIG. 8 is a schematic sectional view of an emergency opening device employed in another embodiment of the invention.

In addition to the emergency opening device 2 in the above embodiment, another embodiment of the invention further provides an emergency opening device 2. FIG. 8 is a schematic sectional view of an emergency opening device 2 employed in another embodiment of the invention. Referring to FIG. 8, in this embodiment of the invention, the first base 201 of the emergency opening device 2 is provided with a sleeve 218, and a first pawl 204 and a first spring 205 are mounted in the sleeve 218; a spring positioning nut 219 is mounted on the top of the sleeve 218; when the spring positioning nut 219 engages the first pawl 204, the first spring 205 is compressed, and the elastic acting force generated by the first spring 205 that is compressed makes the first pawl 204 abut against the first ratchet 203.

Additionally, it may be seen from FIG. 8 that, in this embodiment, the end of the first pawl 204 that protrudes outward from the first base 201 is provided with a lever stop pad; one end of the linkage lever 212 is abutted against the lower side of the lever stop pad, and the first pawl 204 is driven to move axially along the sleeve 218 by pushing the lever stop pad via the linkage lever 212.

Further referring to FIG. 8, the emergency opening device 2 according to this embodiment further includes a screw 213, a screw nut 214, a disk spring, a first friction component 216 and a second friction component 217. Among which, the screw 213 and the first rotary shaft 202 are provided coaxially and are connected fixedly, and the first rotary shaft 202 may drive the screw 213 to rotate.

There is a guide stop hole on the right side of the first base 201, and the extending direction of the guide stop hole is parallel to the axial direction of the screw 213 and the first rotary shaft 202; the screw nut 214 is mounted in the guide stop hole and may move in the extending direction of the guide stop hole; the guide stop hole restricts the circumferential rotation of the screw nut 214; the screw 213 is threaded engaged with the screw nut 214. By employing the above structure, when the screw 213 rotates, the screw nut 214 will translate along the axial direction of the screw 213 under the guide of the guide stop hole.

The deformation direction of the disk spring is parallel to the extending direction of the screw 213; one end of the disk spring is abutted against the screw nut 214, and the other end is abutted against a first friction component 216. A second friction component 217 is fixedly mounted on the first base 201, and the friction surface of the first friction component 216 faces the friction surface of the second friction component 217. The first friction component 216 is spline-connected with the screw 213 and may move along the axial direction of the screw 213.

When the first pawl 204 is detached from the first ratchet 203, under the gravity of the movable sash, the first pulling cable 206 is unwrapped from the first rotary shaft 202 and drives the first rotary shaft 202 to rotate, and the screw nut 214 moves toward the second friction component 217 as driven by the screw 213 and guided by the guide stop hole. Because the second friction component 217 is fixedly mounted on the first base 201, when the screw nut 214 moves to a certain location, the disk spring is deformed, and the friction surface of the first friction component 216 contacts the friction surface of the second friction component 217. Because of spline connection, the first friction component 216 rotates as the screw 213 rotates, and friction force is generated due to relative sliding occurring between the friction surface of the first friction component 216 and the friction surface of the second friction component 217. However, since the friction force is smaller than the tractive force applied on the first pulling cable 206 by the movable sash, the movable sash continues to drop and drive the first pulling cable 206 to be unwrapped from the first rotary shaft 202.

As the first rotary shaft 202 rotates, the distance between the screw nut 214 and the second friction component 217 decreases gradually, and the deformation of the disk spring under the pressure of the screw nut 214 and the second friction component 217 becomes larger and larger, thus the elastic deformation force generated becomes larger and larger. The deformation force generated by the disk spring acts on the first friction component 216, so that the friction force between the friction surface of the first friction component 216 and the friction surface of the second friction component 217 increases gradually. When the first pulling cable 206 is unwrapped to a certain degree, the friction force between the first friction component 216 and the second friction component 217 gets equal to the tractive force applied on the pulling cable by the movable sash, and the dropping speed of the movable sash reaches its maximum value. At this point, the first pulling cable 206 continues to be unwrapped.

As the first pulling cable 206 continues to be unwrapped, the screw nut 214 continues to get closer to the second friction component 217, the deformation of the disk spring further increases, and the friction force between the first friction component 216 and the second friction component 217 becomes larger than the traction force applied on the first pulling cable 206 by the movable sash, thus the dropping speed of the movable sash decreases, and the unwrapping speed of the pulling cable also decreases. Finally, when the movable sash drops to the lowest point, the unwrapping of the pulling cable is basically completed.

By employing the above emergency opening device 2, the unwrapping speed of the first pulling cable 206 from the first rotary shaft 202 first increases and then decreases. Since the dropping speed of the movable sash also first increases and then decreases, the impact of the movable sash on the frame of the sliding window 1 may be decreased consequently.

It should be noted that, the first spring 205, the second spring 210 and the third spring 306 mentioned in the above embodiments are elastic components preferably employed in the specific embodiments of the invention, and other elastic components implementing the corresponding functions may also be employed in other embodiments to replace the first spring 205, the second spring 210 and the third spring 306. Similarly, in other embodiments, other elastic components may also be employed to replace the above disc spring 215.

The sliding window emergency opening system according to the embodiment of the invention has been introduced in detail above. The principles and implementation modes of the invention have been disclosed by specific embodiments. The illustration of above embodiments is merely provided for better understanding the core concept of the invention; without departing from the principles of the invention, all other embodiments obtained by one of ordinary skills in the art with no creative efforts will fall into the protection scope of the invention.

What is claimed is:

1. A sliding window emergency opening system, comprising at least one emergency opening device (2) and a general opening control device (3); wherein each emergency opening device (2) comprises a first base (201), a first rotary shaft (202), a first pulling cable (206), a first ratchet (203), a first pawl (204) and a first elastic component; the first rotary shaft (202) is mounted on the first base (201) and is configured to rotate with respect to the first base (201); the first pulling cable (206) is wound around the first rotary shaft (202), and one end thereof is connected with a movable sash of a sliding window (1); the first ratchet (203) is fixedly connected with the first rotary shaft (202); the first elastic component is compressively provided between the first base (201) and the first pawl (204) and generates a force so as to make the first pawl (204) abut against the first ratchet (203);

the general opening control device (3) comprises a second base (301), a second rotary shaft (302) and a general control pulling cable (303); the second rotary shaft (302) is mounted on the second base (301) and is configured to rotate with respect to the second base (301); one end of the general control pulling cable (303) is connected with the second rotary shaft (302), and the other end thereof is connected with the first pawl (204); when the second rotary shaft (302) rotates, the general control pulling cable (303) is wound to make the first pawl (204) overcome the force of the first elastic component, such that the first pawl (204) gets detached from the first ratchet (203).

2. The sliding window emergency opening system according to claim 1, wherein:

each emergency opening device (2) comprises a branch pulling cable (207), with one end thereof being connected with the first pawl (204); and each of the branch pulling cables (207) is connected with the general control pulling cable.

3. The sliding window emergency opening system according to claim 2, wherein:

each of the branch pulling cables (207) comprises a branch pulling cable body (208) and a traction safety device;

the branch pulling cable body (208) is connected with the general control pulling cable (303);

the traction safety device comprises a second elastic component and a safety pulling cable (211);

a first end of the second elastic component and a first end of the safety pulling cable (211) are both connected with the first pawl (204);

a second end of the second elastic component and a second end of the safety pulling cable (211) are both connected with the branch pulling cable body (208); and a length of the safety pulling cable (211) is equal to a maximum stretched length of the second elastic component, and a maximum deformation length of the second elastic component is larger than or equal to a maximum movement distance of the general control pulling cable (303).

4. The sliding window emergency opening system according to claim 3, wherein:

each emergency opening device (2) comprises a linkage lever (212);

the linkage lever (212) is hingedly mounted on the first base (201); and a first end of the linkage lever (212) is connected with the first pawl (204), and a second end of the linkage lever (212) is connected with both the first end of the second elastic component and the first end of the safety pulling cable (211).

5. The sliding window emergency opening system according to claim 2, further comprising a linkage guide seat (4); wherein the linkage guide seat (4) comprises a guide seat body (401) and a guide bar (402), wherein the guide bar (402) is configured to slide with respect to the guide seat body (401); and the general control pulling cable (303) is connected with the branch pulling cable (207) in each of the emergency opening device (2) via the guide bar (402).

6. The sliding window emergency opening system according to claim 5, wherein:

the linkage guide seat (4) further comprises a guide wheel (403);

the guide wheel (403) is mounted on the guide seat body (401); and the branch pulling cable (207) is connected to the guide bar (402) after bridging over the guide wheel (403).

7. The sliding window emergency opening system according to claim 1, wherein:

the general opening control device (3) further comprises: a second ratchet (304), a second pawl (305) and a third elastic component;

the second ratchet (304) is fixedly connected with the second rotary shaft (302);

the third elastic component is compressively provided between the second base (301) and the second pawl (305) to make the second pawl (305) abut against the second ratchet (304);

after the second pawl (305) is operated to overcome a compression elastic force of the third elastic component and to make the second pawl (305) detach from the second ratchet (304), the second rotary shaft (302) is configured to rotate with respect to the second rotary shaft (302) to wind up the general control pulling cable (303).

8. The sliding window emergency opening system according to claim 1, wherein:

the general opening control device (3) further comprises a handle (307) and a stop pin (308);

the handle (307) is fixedly connected with the second rotary shaft (302), and the handle (307) is provided with a first pin hole;

the second base (301) is provided with a second pin hole corresponding to the first pin hole; and the stop pin (308) is configured to be both inserted into the first pin hole and the second pin hole.

9. The sliding window emergency opening system according to claim 1, further comprising:

a pulling cable sleeve (5) sheathing the general control pulling cable (303).

10. The sliding window emergency opening system according to claim 1, further comprises:

a screw (213) that is connected with the first rotary shaft (202) and rotates with the first rotary shaft (202);

a screw nut (214) threaded with the screw (213);

a guide guiding the screw nut (214) to move along an axial direction of the screw (213) while restricting the rotation of the screw nut (214), wherein the guide is fixedly provided on the base;

a first friction component (216) that is sleeved on the screw (213), rotates together with the screw (213) and moves along the axial direction of the screw (213);

a second friction component (217) that is fixedly mounted on the first base (201) and frictionally cooperates with the first friction component (216), wherein the second friction component (217) and the screw nut (214) are located on the two sides of the first friction component (216);

a fourth elastic component that is mounted between the first friction component (216) and the screw nut (214);

when the first rotary shaft (202) rotates along a first direction, the pulling cable is unwound from the first rotary shaft (202), and the screw nut (214) moves toward the second friction component (217) and presses against the fourth elastic component.

* * * * *